US005263400A

United States Patent [19]

Huesser

[11] Patent Number: 5,263,400

[45] Date of Patent: * Nov. 23, 1993

[54] HYDRAULIC CONTROL DEVICE

[75] Inventor: Martin Huesser, Munich, Fed. Rep. of Germany

[73] Assignee: Heilmeier & Weinlein Fabrik fuer Oel-Hydraulik GmbH & Co. KG, Fed. Rep. of Germany

[ * ] Notice: The portion of the term of this patent subsequent to Nov. 9, 2010 has been disclaimed.

[21] Appl. No.: 844,737

[22] Filed: Mar. 2, 1992

[30] Foreign Application Priority Data

Mar. 11, 1991 [DE] Fed. Rep. of Germany ..... 4107776

[51] Int. Cl.[5] ..... F15B 11/08; F15B 13/04

[52] U.S. Cl. ..... 91/420; 91/426; 91/447; 60/468

[58] Field of Search ..... 91/440, 445, 446, 447, 91/420, 421, 426, 461; 60/460, 461, 466, 468

[56] References Cited

U.S. PATENT DOCUMENTS

| | | | |
|---|---|---|---|
| 4,041,841 | 8/1977 | Haskew | 91/421 |
| 4,118,149 | 10/1978 | Hagberg | 60/468 X |
| 4,610,193 | 9/1986 | Barker et al. | 91/420 |

FOREIGN PATENT DOCUMENTS

| | | | |
|---|---|---|---|
| 2036547 | 1/1972 | Fed. Rep. of Germany | 91/420 |
| 2352742 | 5/1974 | Fed. Rep. of Germany | 91/420 |
| 2838940 | 3/1980 | Fed. Rep. of Germany . | |
| 0065404 | 4/1982 | Japan | 91/420 |

OTHER PUBLICATIONS

Heilmeier & Weinlein "D7100", Mar. 11, 1991.

*Primary Examiner*—Edward K. Look
*Assistant Examiner*—Hoang Nguyen
*Attorney, Agent, or Firm*—Kinzer, Plyer, Dorn, McEachran & Jambor

[57] ABSTRACT

In a control device (S) for a hydraulic motor (V) which is adapted to be acted upon at both sides, there are provided working conduits (4, 5) which are alternately connectable via a directional control valve (C) to a pressure source (P) and a tank (T), a load holding valve (H) which is hydraulically openable in a controlled way and is arranged in at least one working conduit (4), as well as a control pressure conduit (13) which is connected to the opening side (16) of said load holding valve (H), with pressure variations arising during the controlled opening of the load holding valve, and the amplitudes of the pressure variations being adapted to be dampened in the control pressure conduit (13) at least via a damping throttle (D). To dampen and eliminate the undesired effect of changes in the viscosity of the pressure medium and/or of a damping throttle which is too tightly set, the damping throttle (D) can be bypassed in both directions by a respective check valve (R1, R2, R1', R2,), a great biasing force which biases the one check valve being adjusted to a value which lies between the pressure values of the pressure extremes that act on said check valve and pertain to at least the first amplitude and the next amplitude of the pressure variations.

8 Claims, 3 Drawing Sheets

HYDRAULIC CONTROL DEVICE

DESCRIPTION

This invention relates to a hydraulic control device according to the preamble of patent claim 1.

In a control device of this type, as is known from publication D 7100, June 1986, edited by Heilmeier & Weinlein, the damping throttle is set in the control pressure conduit in such a way that, when the pressure medium is operatively warm and the load holding valve opened in a controlled way, it effects a decay of the amplitudes of the pressure variations. For preventing any delay in the controlled closing movement of the load holding valve and any after-running of the hydraulic motor under load, the damping throttle may be bypassed by a check valve which ensures a swift pressure reduction during closing. Although pressure variations in the pressure control conduit and load movements caused thereby are gradually dampened by means of the damping throttle, some of them can clearly be felt because the load holding valve is subject to play and the hydraulic motor reacts unevenly. It has been found in practice that the dampening effect of the damping throttle is above all unsatisfactory in load systems that have a strong tendency to vibrate. When the load holding valve is rapidly opened in a controlled way, this produces pressure variations with a relatively harmonious vibration curve. In such a case, at least the first amplitude of the pressure variations has a high maximum and a low minimum while the subsequent amplitudes decrease gradually. The pressure values of the extremes of the first amplitude(s) are known. The pressure variations during rapid opening of the load holding valve result not only from a rapid pressure build-up, but also from conditions of the load which moves (downwards) after the controlled opening of the load holding valve and vibrates and thus acts on the pressure medium column within the hydraulic circuit of the control device. Pressure variations are unavoidable, but it is desirable to dampen them as fast as possible. Furthermore, a damping throttle which is tightly set for achieving a strong dampening action may delay the controlled opening movement. This disadvantageous effect is above all observed with a cold and tenacious pressure medium, as the damping throttle is responsive to viscosity.

In accordance with the invention, this object is attained through the features outlined in the characterizing part of claim 1.

When the pressure rises, the respective check valve which is strongly biased opens at least during the first amplitude as soon as the biasing force has been overcome. Depending on whether the one or the other check valve is strongly biased, the peak of the amplitude is eliminated down to the minimum of the pressure value of the pressure variation which could not be dampened by the damping throttle. A rapid decay of the first and the subsequent amplitudes is effected at the opening side. This is especially advantageous with a cold pressure medium and/or with a tightly set damping throttle because the check valves do not only support the dampening action of the damping throttle, but compensate for the damping throttle effect which is not desired under specific operating conditions. The amplitudes of the pressure variations which become effective at the opening side of the load holding valve are dampened as rapidly as possible, so that the load holding valve immediately enables the hydraulic motor to move uniformly under load, i.e. virtually from the beginning of the movement. The rapid dampening of the pressure variations at the opening side of the load holding valve has a dampening effect on pressure variations in the whole system.

According to one solution, the pressure which does not pass through the damping throttle opens the strongly biased check valve towards the opening side of the load holding valve as soon as it has overcome the biasing force. The upper part of the peak of the at least first amplitude of the pressure variations is no longer effective at the opening side of the load holding valve. A more easy decay of the other amplitudes is thus made possible. Along the falling part of the first amplitude or the first amplitudes, the second check valve which is almost unbiased permits a rapid pressure reduction, too. The two check valves cooperate with the damping throttle during dampening operations; they take over those parts of the pressure variations the damping throttle cannot cope with. Not only the amplitudes of the pressure variations decay rapidly, but there is the additional important advantage that any viscosity-dependent delay in the controlled opening and closing of the load holding valve through the damping throttle is suppressed, as well as a delay that might be caused by a tight setting of the damping throttle for damping reasons.

In another embodiment the strongly biased first check valve responds not only to the first amplitude, but to several initial amplitudes of the pressure variations to effect, together with the damping throttle, a very rapid decay of the pressure variations that are effective at the opening side. This is especially expedient for a cold and thus viscous pressure medium because in such a case the damping throttle works in an unsatisfactory way on account of its viscosity dependence.

In yet another embodiment the first amplitude or amplitudes of the pressure variations reach the opening side of the load holding valve through the only slightly biased first check valve, with the damping throttle being bypassed, so that the controlled opening movement of the valve takes place immediately. However, the lower portion of the first amplitude or amplitudes is diminished through the second check valve which is biased in the opposite direction, which promotes the rapid decay of the amplitudes. The second check valve is expediently biased to only such an extent that it is responsive to the pressure reduction established for the controlled closing of the load holding valve, and bypasses the damping throttle so as to avoid any delay in the controlled closing movement, even in the case of a cold and viscous pressure medium.

According to another embodiment plurality of initial amplitudes are made to decay rapidly due to the response of the second, strongly biased check valve at the opening side.

Another embodiment is simple from a constructional point of view, for spring-biased check valves are simple, reliable and inexpensive hydraulic members. The biasing force can be exactly adapted by means of the adjusting device to the operating conditions so as to effect an optimum damping action.

According to another embodiment since the damping throttle can also be adapted to the operating conditions. The two check valves that cooperate with the damping throttle have the additional advantage that the damping throttle can be adjusted substantially independently of the course and extent of the pressure variations with a view to optimum damping. Hence, there is no longer any compromise adjustment of the damping throttle as has so far been practiced in conventional control systems, where the capacity of the damping throttle has not been exploited fully.

To effect a rapid decay of the pressure variations also at the side of the damping throttle which faces away from the opening side of the load holding valve, the pressure medium according to another embodiment flows constantly off via the bypass conduit. The course of the amplitudes of the pressure variations is so effectively disturbed by the throttle passage in the control pressure conduit and the disturbance throttle passage in the bypass conduit, i.e. also in front of the damping throttle, that they decay rapidly. The pressure variations are dampened through the joint action of three measures, namely, damping throttle, check valves and bypass duct, and the control device is especially suited for vibration-prone or strongly vibratory systems. Since the two check valves take part in the damping action, the disturbance throttle passage need only be slightly greater than the throttle passage in the control pressure conduit, so that only an infinitely small amount of pressure medium flows off via the bypass conduit.

Of course, since the dampening effect via the bypass duct can only take place if a pressure medium volume is actually moved, the bypass conduit can connected to the working conduit containing the load holding valve or directly to the tank. These features are incorporated in other embodiments of the invention. In the last-mentioned case, a directional control valve with supply controllers and a blocked central position may be used. Such a valve is per se critical in vibration-prone or greatly vibratory systems of this type because of its long transient response. In any case, the strong dampening effect which can be achieved by taking the above-mentioned measures permits the use of directional control valves equipped with supply controllers, which is of advantage to the control accuracy and the response characteristics of the control device during movement of the hydraulic motor in any direction.

Embodiments of the subject matter of the invention shall now be explained with reference to the drawing, in which.

Figure 1:
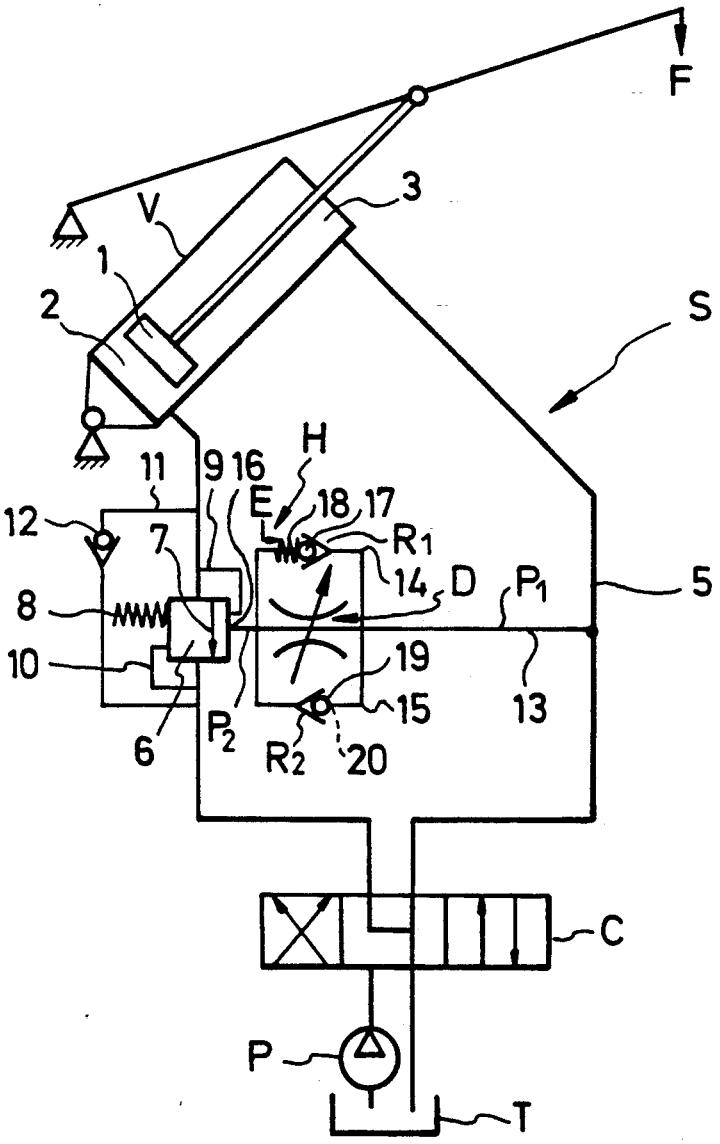
FIG. 1 is a block diagram of a first embodiment of a hydraulic control device.

A hydraulic control device S according to FIG. 1 serves to control the movement of a consumer V with which a load F is moved. Consumer V is, e.g., the lifting or bent cylinder of a crane with which load F is moved.

In the hydraulic motor V, a piston 1 divides a cylinder into two chambers 2 and 3. Each of chambers 2 and 3 is alternately connectable to a pressure source P and a tank T via a working conduit 4, 5 and a directional control valve C. At least working conduit 4 has disposed therein a load holding valve H which contains a valve 6 with a valve member 7 which is brought by a spring 8 into the illustrated closing position in which conduit 4 is blocked. The pressure prevailing in a precontrol conduit 10 acts in the same direction, whilst the pressure prevailing in a precontrol conduit 9 acts in the opening direction. A conduit loop 11 bypasses valve 6 in working conduit 4 and contains a check valve 12 opening towards hydraulic motor V.

A control pressure conduit 13 branches from the other working conduit 5 to the opening side 16 of valve 6. Control pressure conduit 13 contains a preferably adjustable damping throttle D. Two conduit loops 14 and 15 bypass damping throttle D. Conduit loop 14 contains a first check valve R1 including a valve member 17 and a biasing spring 18, which opens towards the opening side 16. The biasing force of spring 18 can be adjusted with the aid of the outlined adjusting device E. Conduit loop 15 contains a second check valve R2 which opens towards the second working conduit 5 and contains a valve member 19 and, optionally, a weak biasing spring 20.

The two check valves R1, R2 are differently biased. The bias of the second check valve R2 may even become zero. In practice, a weak spring is used for positioning valve member 20 in the shut-off position in the inoperative state. By contrast, the bias of the first check valve R1 is great. The force with which valve member 17 is biased by spring 18 has a value which is smaller than the pressure value of the pressure maximum that acts on valve member 17 and pertains at least to the first amplitude (FIG. 4) of the pressure variations of pressure Pl, and is slightly greater than the pressure value of the pressure maximum of the subsequent amplitudes.

Figure 4:
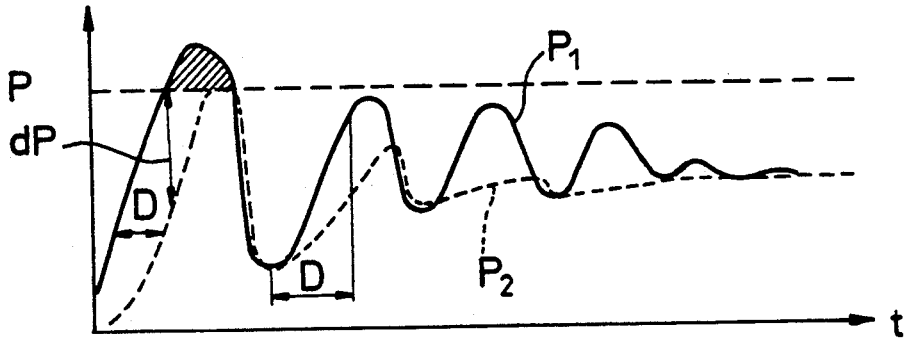
FIG. 4 is a diagram regarding the embodiment of FIG. 1 and FIG. 3 respectively.

FIG. 4 illustrates the pressure curve over time which follows from pressure variations in control pressure conduit 13 (pressure Pl between damping throttle D and working conduit 5), which pressure variations are typical of the rapid establishment of a lowering movement of the load.

For the movement of hydraulic motor V under load, load holding valve H is opened in a controlled way, e.g., via directional control valve C, by exerting pressure on working conduit 5 until load holding valve H opens the passage of working conduit 4. Pressure Pl follows, e.g., the curve shown in full line. The pressure variations would have subsequent and very slowly decreasing amplitudes with a respective pressure maximum and a pressure minimum. If the pressure variations constantly acted on the opening side 16 of the load holding valve, the movement of hydraulic motor V would not be uniform. A decay of the pressure variations which is as rapid as possible is therefore necessary, at least at the opening side 16 (pressure P2 in FIG. 1, curve shown in broken line in FIG. 4). The biasing force of spring 18 in FIG. 1 is set to the value shown in broken line, which is below the pressure maximum of the first amplitude and just above the pressure maximum of the second and subsequent amplitudes. As a result of the action of damping throttle D and the first check valve R1, the pressure increase in the first amplitude becomes effective at the opening side 16 with a phase shift. When the biasing force of the first check valve is reached, the latter opens, so that the peak of the first amplitude is cut off before pressure P2 approximately follows the pressure drop at the rear slope of the first amplitude. Damping throttle D is here bypassed. At the beginning of the next amplitude, damping throttle D becomes effective, so that the increase in pressure at the opening side 16 is already less steep and the second amplitude is dampened. Likewise, the damping throttle effects a rapid decay of the other amplitudes at the opening side. As a result, the lowering movement of hydraulic motor V takes place without any jerks and in a uniform way immediately after the beginning of the movement, namely, at the speed set on the directional control valve.

In a modification of the embodiment illustrated in FIG. 1, it is also possible to feed control pressure conduit 13 from an extra control pressure reservoir. In this case, however, pressure variations, e.g., according to FIG. 4 also arise when the opening pressure is rapidly established for stopping hydraulic motor V, as can often be observed in practice.

Figure 2:
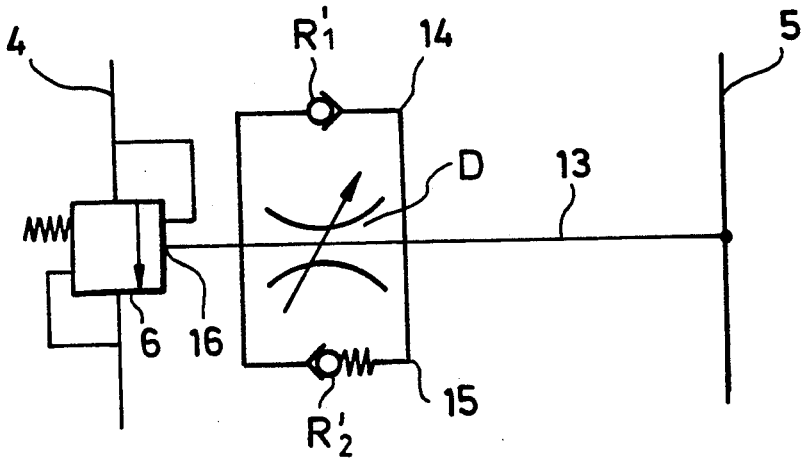
FIG. 2 shows part of a block diagram of a second embodiment.
Figure 5:
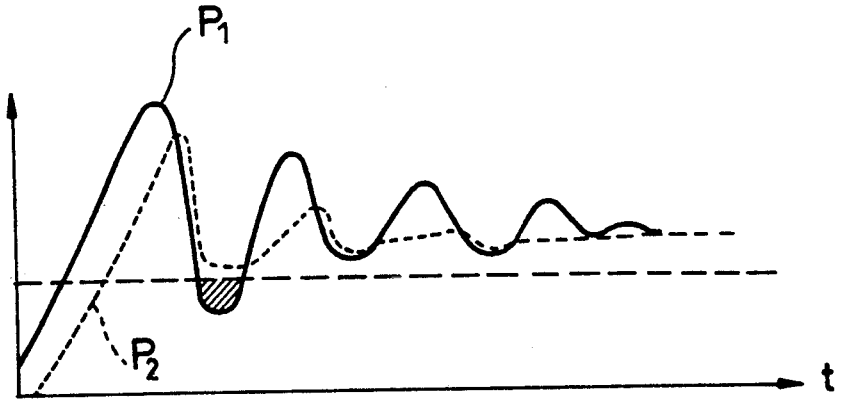
FIG. 5 is a diagram regarding the embodiment of FIG. 2.

The embodiment of FIG. 2 differs from that of FIG. 1 by the exchange of the bias of the two check valves used for bypassing damping throttle D. The first check valve R1' which opens towards the opening side 16 is biased with a biasing force that may even become zero, i.e. with a very small biasing force, whereas the second check valve R2' that opens in the opposite direction is biased with a great biasing force. When there are pressure variations (FIG. 5), this results in a dampening effect at the opening side 16. The first amplitude of the pressure variations of pressure P1 follows the first amplitude of the pressure variation of pressure P2 at the opening side with the phase shift effected by damping throttle D. The maximum of the pressure value of the first amplitude of pressure Pl is not reached by pressure P2 because of damping throttle D, but pressure P2 follows the falling slope of the first amplitude of pressure P1. The biasing force of the second check valve R2 has a value (broken horizontal line in FIG. 5) which is higher than the minimum of the pressure value of the first amplitude of pressure P1, but lower than the minimum of the pressure values of the subsequent amplitudes of pressure P1. Thus, when the value of the biasing force is not reached, the second check valve R2 opens before the first amplitude reaches its minimum pressure value. The bottom between the first and second amplitudes of the pressure variations is cut off, pressure P2 first remains at the level of the biasing pressure of the second check valve R2' before damping throttle D becomes active during renewed rise in the second amplitude and causes pressure P2 to rise more gently. A rapid decay of the pressure variations at the opening side 16 is thus achieved.

The bias on the second check valve R2' is expediently adjusted such that the second check valve R2' opens when the pressure in the pressure control conduit is relieved for the controlled closing of the load holding valve. This prevents a delay in the closing movement via the damping throttle.

In the two above-described embodiments, it is also possible to set the biasing force on the more strongly biased check valve such that the tops or bottoms of several initial amplitudes are cut off and the damping throttle only dampens subsequent amplitudes.

Figure 3:
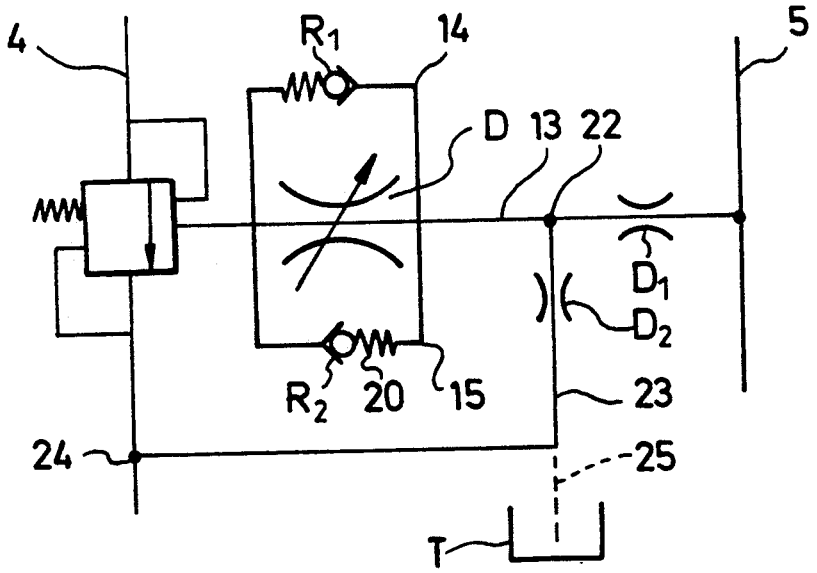
FIG. 3 shows part of a block diagram of a third embodiment.

The embodiment of FIG. 3 differs from the two above-described embodiments by an additional damping means in the control circuit of the load holding valve. This damping device consists of a bypass duct 23 which branches from control pressure conduit 13 at a junction 22 and which leads either to a connection point 24 in working conduit 4 or directly to tank T (as outlined by the broken line at 25). A throttle passage D1 is provided between working conduit 5 and junction 22. Bypass conduit 23 contains a disturbance throttle passage D2 which is slightly greater than throttle passage D1. The damping means helps to dampen the vibration amplitudes in that a pressure medium flows off constantly via the two throttle passages and disturbs the propagation of the vibration amplitudes, so that the latter will decay very rapidly. The damping means ensures the damping of pressure variations also during movement of hydraulic engine V in the load lifting direction and also during pressure variations when the load is stopped. The two check valves R1 and R2 are arranged and biased in the way shown for the embodiment illustrated in FIG. 1.

However, it is also possible to use the reverse arrangement and bias of FIG. 2 in the embodiment of FIG. 3. The effect is similar in the two cases.

In all embodiments, damping throttle D can also be set tightly for achieving optimum damping. Nevertheless, any delay in the controlled closing and opening movements of the load holding valve is prevented in a cold and thus viscous pressure medium.

I claim:

1. A hydraulic control device for a hydraulic motor for moving a load in two directions, comprising two working conduits which are alternately connectable via a directional control valve to a pressure source and a tank and lead to said hydraulic motor, a load holding valve which is hydraulically openable in an opening direction in a controlled way for moving said hydraulic motor under load and which is arranged in at least one of said working conduits, and a control pressure conduit connected to the opening side of said load holding valve, pressure variations arising in said control pressure conduit during the controlled opening of said loading holding valve and the amplitudes of said pressure variations being adapted to be dampened in said control pressure conduit at least via a damping throttle provided in said control pressure conduit, and a first conduit loop of said control pressure conduit deviating said damping throttle and containing a first check valve for bypassing said damping throttle in the closing direction of said load holding valve, characterized in that in said control pressure conduit a second conduit loop for deviating said damping throttle is provided, said second conduit loop containing a second check valve opening in the opening direction of said load holding valve, that said first check valve is biased in shut-off direction with a biasing force of a weak biasing spring being just strong enough to position said first valve in the shut-off position in the inoperational state, whereas the second check valve is biased in shut-off direction with a considerably greater biasing force of a strong biasing spring, and that said biasing force of said strong biasing spring is smaller than the pressure valve of the pressure maximum of at least the first amplitude of the pressure variations, with said pressure maximum acting on said second check valve, and is slightly greater than the pressure value of the pressure maximum of the subsequent amplitude.

2. A hydraulic control device for a hydraulic motor for moving a load in two directions, comprising two working conduits which are alternately connectable via a directional control valve to a pressure source and a tank and lead to said hydraulic motor, a load holding valve which is hydraulically openable in opening direction in a controlled way for moving said hydraulic motor under load and which is arranged in at least one of said working conduits, and a control pressure conduit connected to the opening side of said load holding valve, pressure variations arising in said control pressure conduit during the controlled opening of said load holding valve and the amplitudes of said pressure variations being adapted to be dampened in said control pressure conduit at least via a damping throttle provided in said control pressure conduit, and a first conduit loop of said control pressure conduit deviating said damping throttle and containing a first check valve for bypassing said damping throttle in the closing direction of said load holding valve, characterized in that a second conduit loop is provided in said controlled pressure conduit deviating said damping throttle and containing a second check valve which opens in the opening direction of said load holding valve, that said second check valve is biased in shut-off direction with a biasing force of a weak biasing spring being just strong enough to position said second check valve in its shut-off position in the inoperative state, whereas said first check valve is biased in shut-off direction with a considerably greater biasing force of a strong biasing spring, and that said biasing force of said strong biasing spring is greater than the pressure value of the minimum of at least the first amplitude of the pressure variations, with said pressure minimum acting on said first check valve, and is slightly smaller than the pressure value of the pressure minimum of the next amplitude.

3. A hydraulic control device according to claim 1, characterized in that the biasing force of the biasing spring of said second check valve is smaller than the pressure values of the pressure maxima which act on said second check valve and pertain to a predetermined number of first amplitudes of the pressure variations.

4. A hydraulic control device according to claim 2, characterized in that the biasing force of said biasing spring of said first check valve is greater than the pressure values of the pressure minima which act on said first check valve and pertained to a predetermined number of first amplitudes of the pressure variations.

5. A hydraulic control device according to claim 1, characterized in that an adjusting device is provided for adjusting the resilient biasing force of said strong biasing spring.

6. A hydraulic control device according to claim 2, characterized in that an adjusting device is provided for adjusting the resilient biasing force of said strong biasing spring.

7. A hydraulic control device according to claim 1, characterized in that a bias conduit branches off from said control pressure conduit, facing away from said damping throttle, and that a throttle passage is provided in said control pressure conduit at the side of the junction of said bypass conduit facing away from said damping throttle, that a disturbance throttle passage which is greater than said throttle is provided in said bypass conduit, and that said bypass conduit is either connected to said working conduit containing said load holding valve or to said tank.

8. A hydraulic device according to claim 2, characterized in that a bias conduit branches off from said control pressure conduit, facing away from said damping throttle, and that a throttle passage is provided in said control pressure conduit at the side of the junction of said bypass conduit facing away from said damping throttle, that a disturbance throttle passage which is greater than said throttle is provided in said bypass conduit, and that said bypass conduit is either connected to said working conduit containing said load holding valve or to said tank.

* * * * *